US009127343B2

(12) United States Patent
Su

(10) Patent No.: US 9,127,343 B2
(45) Date of Patent: Sep. 8, 2015

(54) SURFACE TREATING METHOD FOR A GOLF CLUB HEAD

(71) Applicant: Chi-Hung Su, Tainan (TW)

(72) Inventor: Chi-Hung Su, Tainan (TW)

( * ) Notice: Subject to any disclaimer, the term of this patent is extended or adjusted under 35 U.S.C. 154(b) by 0 days.

(21) Appl. No.: 14/531,164

(22) Filed: Nov. 3, 2014

(65) Prior Publication Data

US 2015/0047747 A1 Feb. 19, 2015

Related U.S. Application Data

(63) Continuation-in-part of application No. 13/679,811, filed on Nov. 16, 2012, now abandoned.

(51) Int. Cl.

| | |
|---|---|
| ***C23C 8/34*** | (2006.01) |
| ***A63B 53/04*** | (2015.01) |
| ***B24C 1/00*** | (2006.01) |
| ***C23C 8/02*** | (2006.01) |
| ***C23C 8/80*** | (2006.01) |

(52) U.S. Cl.

CPC . *C23C 8/34* (2013.01); *A63B 53/04* (2013.01); *B24C 1/00* (2013.01); *C23C 8/02* (2013.01); *C23C 8/80* (2013.01); *A63B 2209/00* (2013.01)

(58) Field of Classification Search

CPC ..... C23C 8/34; C23C 8/02; C23C 8/80; A63B 53/04; B24C 1/00; B24C 9/00

See application file for complete search history.

(56) References Cited

U.S. PATENT DOCUMENTS

| | | | | |
|---|---|---|---|---|
| 4,496,401 | A | 1/1985 | Dawes et al. | |
| 5,531,444 | A * | 7/1996 | Buettner | 473/349 |
| 5,741,372 | A | 4/1998 | Gugel | |
| 6,451,129 | B2 | 9/2002 | Sato et al. | |
| 8,128,994 | B1 | 3/2012 | Folck et al. | |
| 2001/0053460 | A1 * | 12/2001 | Sato et al. | 428/687 |
| 2002/0032073 | A1 * | 3/2002 | Rogers et al. | 473/324 |
| 2007/0251605 | A1 | 11/2007 | Kim | |
| 2009/0199932 | A1 * | 8/2009 | Zak | 148/281 |

FOREIGN PATENT DOCUMENTS

| | | |
|---|---|---|
| CN | 102553185 A | 7/2012 |
| JP | 01-167276 | 11/1989 |
| JP | 04-336083 | 11/1992 |
| JP | 05-074562 | 10/1993 |

(Continued)

OTHER PUBLICATIONS

DIY Golf—How to Finish Your Own Wedges. Nov. 29, 2009. <http://www.mygolfspy.com/torch-flaming-golf-wedges.
English abstract translation of CN102553185A.
English abstract translation of JP2001170867.
English abstract translation of JP2008023178.

(Continued)

*Primary Examiner* — Lee D Wilson
*Assistant Examiner* — Joel Crandall
(74) *Attorney, Agent, or Firm* — WPAT, P.C.; Anthony King

(57) ABSTRACT

A surface treating method for a golf club head made of carbon steel basically has one nitriding step and two oxidizing steps. The method further has polishing, sandblasting and rinsing steps and so on processed prior to or between the basic steps, and then has polishing and oil immersing steps and so on processed after the basic steps. The finished golf club head has uniform dark appearance and also has good corrosion resistance and abrasion resistance. Furthermore, the surface of the finished golf club head does not peel off. Moreover, the method also has advantages including low pollution and low cost.

8 Claims, 1 Drawing Sheet

(56) References Cited

FOREIGN PATENT DOCUMENTS

| | | |
|---|---|---|
| JP | 10-085370 | 4/1998 |
| JP | 2000-096208 | 4/2000 |
| JP | 2001-170867 A | 6/2001 |
| JP | 2002-000779 | 1/2002 |
| JP | 2008-023178 | 2/2008 |
| TW | 568791 | 1/2004 |
| TW | 592749 | 6/2004 |
| WO | 2004078277 | 9/2004 |

OTHER PUBLICATIONS

English abstract translation of JP2002000779.
English abstract translation of JP2000096208.
English abstract translation of JPH04336083 (A).
English abstract translation of JPH1085370.
Combined Search and Examination Report from corresponding JP application 2013-002660.
Combined Search and Examination Report from corresponding TW application 101139657.

* cited by examiner

SURFACE TREATING METHOD FOR A GOLF CLUB HEAD

CROSS-REFERENCE TO RELATED APPLICATIONS

This application is a continuation in part application of U.S. patent application filed on Nov. 16, 2012 and having application Ser. No. 13/679,811, the entire contents of which are hereby incorporated herein by reference.

BACKGROUND OF THE INVENTION

1. Field of the Invention

The present invention relates to a manufacturing method for a golf club head, particularly to a surface treating method for a golf club head that has been formed by a forming progress.

2. Description of the Prior Arts

A conventional golf club head made of carbon steel easily rusts so that the conventional golf club head made of carbon steel is subjected to surface treatment by electroplating, ion plating and so on to improve the appearance of the conventional golf club head.

With regards to electroplating technology, the conventional golf club head is electroplated with a nickel layer or a chromium layer in bright silver. The thickness of the nickel layer is about 20 to 25 μm and the thickness of the chromium layer is about 3 to 8 μm. However, because the electroplating surface treating method is processed with heavy metal chemical agents, the environment is polluted and human health is harmed. Further, the electroplating layer is not secured tightly on the golf club head. When the conventional golf club head is used after a period of time, the electroplating layer easily peels off. Moreover, with the nickel layer or the chromium layer, the appearance of the golf club head can only be made in bright silver, but cannot be made in black, dark brown or other dark colors.

As for ion plating technology, the golf club head can be made in iron gray, black or other dark colors. However, using ion plating method to treat the surface of the golf club head costs high. Further, thickness of the black layer made by the ion plating is only about 1 to 5 μm such that the layer made by the ion plating has poor corrosion resistance and abrasion resistance.

In addition, a conventional method for producing steel article, disclosed in U.S. patent application No. 2007/0251605, discloses a surface treating method including one nitriding step and one oxidizing step. However, the conventional method fails to disclose preheating prior to nitriding and oxidizing, and thus the surface compound layer formed by nitriding and the colored oxide film layer formed by oxidizing may not be smooth and even in shape.

To overcome the shortcomings, the present invention provides a surface treating method for a golf club head to mitigate or obviate the aforementioned problems.

SUMMARY OF THE INVENTION

The main objective of the present invention is to provide a surface treating method that conditions the golf club head to have good corrosion resistance and abrasion resistance and also to have a good appearance. The surface treating method for a golf club head made of carbon steel basically has one nitriding step and two oxidizing steps. The method further has polishing, sandblasting, and rinsing steps and so on processed prior to or between the basic steps, and then has polishing and oil immersing steps and so on processed after the basic steps. The finished golf club head has uniform dark appearance and also has good corrosion resistance and abrasion resistance. Furthermore, the surface of the finished golf club head does not peel off. Moreover, the method also has advantages including low pollution and low cost.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
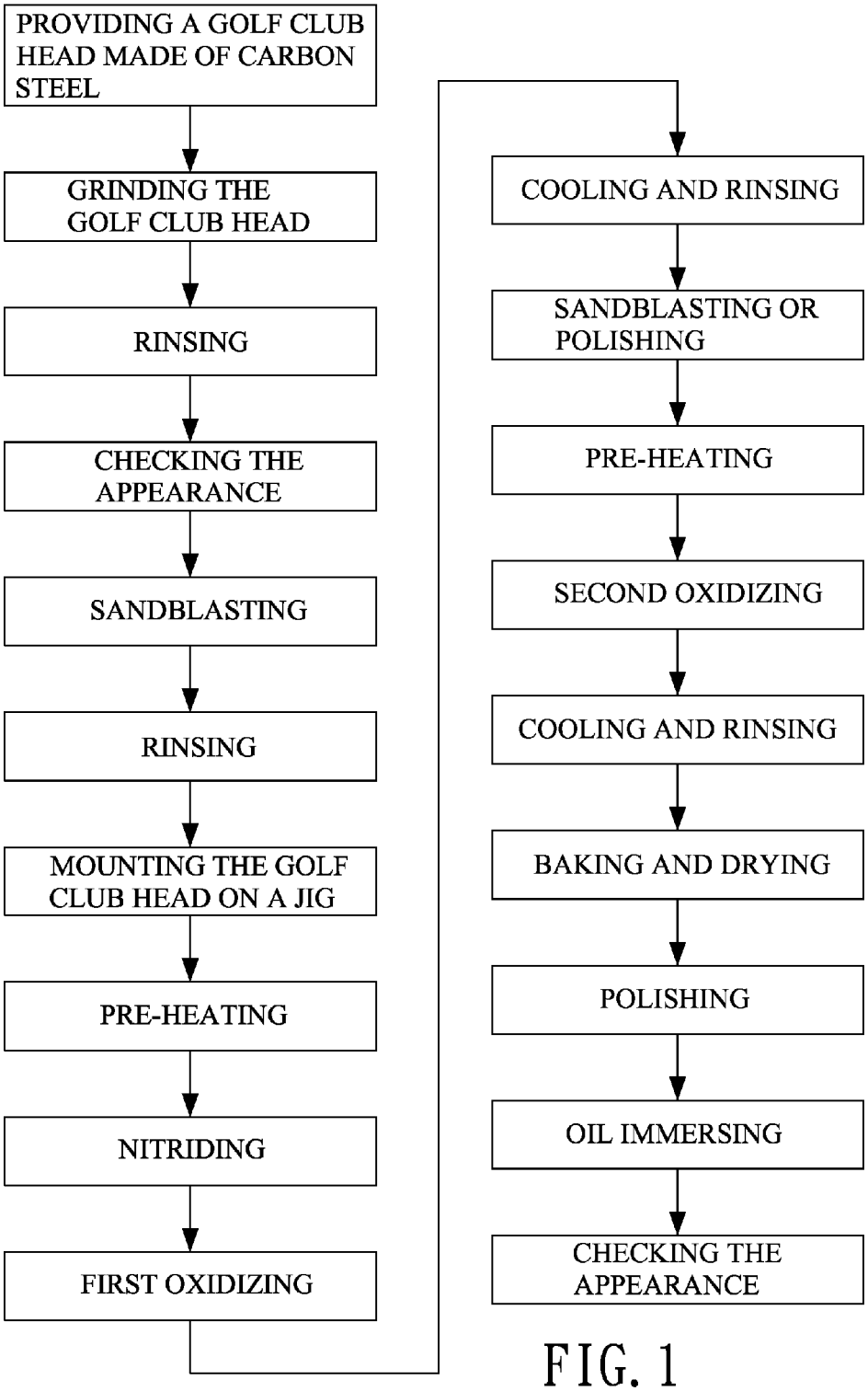
FIG. 1 is a flow chart of a surface treating method for a golf club head in accordance with the present invention.

With reference to FIG. 1, a surface treating method for a golf club head in accordance with the present invention comprises the following acts.

A golf club head is provided. The golf club head is made of carbon steel such as low carbon steel, medium carbon steel and high carbon steel, or is made of alloy steel consisting of carbon steel and other materials that are added with certain purposes by casting, forging or other means. The golf club head may be wood golf club head or iron golf club head.

The golf club head is ground by grinding machine performing grinding means on the golf club head to condition the shape of the golf club head.

The surface of the ground golf club head is rinsed to remove the residues on the surface of the golf club head. In a preferred embodiment, the golf club head is rinsed by ultrasonic means.

The surface of the rinsed golf club head is checked to inspect whether there is any flaw on the surface of the golf club head. In a preferred embodiment, the surface of the golf club head is checked to inspect whether the shape of the golf club head is qualified, or whether holes are formed on the surface of the golf club head. The golf club heads having non-qualified shapes or holes are eliminated and the golf club heads that are qualified are preserved.

The qualified golf club head is sandblasted to form a predetermined abrasive surface on the golf club head.

The sandblasted golf club head is rinsed to remove the residues on the surface of the golf club head. In a preferred embodiment, the golf club head is rinsed by chemical agents such as acetone.

Then the golf club head is mounted on a jig and is transported. The jig is chosen based on the size of the golf club head and protects the golf club head to keep the golf club head from pressing and bumping in the following steps.

The golf club head on the jig is pre-heated by passing through an environment at 350° C. to 400° C. so that the water on the surface of the golf club head is removed to keep the surface of the golf club head dry and the golf club head is also pre-heated to a predetermined temperature.

The pre-heated golf club head is nitrided. The pre-heated golf club head is put into a sealed nitriding reactor at 350° C. to 400° C. for one to three hours. With the active nitrogen generated by the nitriding reactor permeating into the golf club head, the surface of the golf club head has a nitride layer having good corrosion resistance and abrasion resistance.

The nitrided golf club head is processed with first oxidizing. In a preferred embodiment, the golf club head is put into an aerobic environment at 380° C. to 450° C. for thirty to sixty minutes to form an oxide layer on the surface of the golf club head. Therefore, the oxide layer is formed outside the nitride layer to protect the nitride layer properly.

Then the golf club head is cooled and rinsed. The surface of the golf club head is rinsed and cooled down.

The golf club head is sandblasted or polished. The golf club head is taken off from the jig and the surface of the golf club head is sandblasted or polished to remove the loosening layer on the nitride layer and to remove a part of the oxide layer.

The golf club head is mounted on the jig again and transported. The jig protects the golf club head to keep the golf club head from pressing and bumping in the following steps.

The golf club head on the jig is pre-heated by passing through an environment at 350° C. to 400° C. so that the golf club head is pre-heated to a predetermined temperature.

The nitrided golf club head is processed with second oxidizing. In a preferred embodiment, the golf club head is put into an aerobic environment at 380° C. to 450° C. for thirty to sixty minutes to form a dark oxide layer on the surface of the golf club head in dark colors such as black, dark blue or dark brown. Further, by the second oxidization, the dark oxide layer on the surface of the golf club head also displays a uniform color.

Then the golf club head is cooled and rinsed. The surface of the golf club head is rinsed and cooled down.

The golf club head is baked to dry the surface of the golf club head. In a preferred embodiment, the golf club head is put in the oven at 60° C. for about thirty minutes.

The golf club head is polished to display a uniform dark appearance on the golf club head such as black, dark blue, dark brown and so on.

The golf club head is oil immersed. The golf club head is put into the oven at 60° C. for pre-heating. When the golf club head is taken out from the oven, the golf club head is immediately immersed in the antirust oil at 60° C. and then taken out of the antirust oil and stands at room temperature for fifteen to thirty minutes. Then the golf club head is swabbed to be dried by dry cloth.

The appearance of the oil immersed golf club head is checked to inspect whether color uniformity of the golf club head is qualified to finish the surface treatment. In a preferred embodiment, the appearance of the oil immersed golf club head is checked to inspect whether a luster of the surface of the golf club head is qualified.

With the aforementioned steps, the surface treating method as described has the following advantages:

1. Low contamination, low environmental pollution and conforming to environmental protection: The surface treating method as described uses the nitriding means and oxidizing means for two times to treat the surface of the golf club head so that the chemical agents are reduced to lower the pollution and to conform to the environmental protection.

2. Good corrosion resistance and abrasion resistance: The surface treating method as described uses the nitriding means and oxidizing means for two times to provide the layer on the surface of the golf club head with good corrosion resistance and abrasion resistance, and also to provide good antirust function for the surface of the golf club head made of carbon steel.

3. No layer peeling off: Because the surface treating method as described uses the nitriding means and oxidizing means for two times, the nitrogen permeates into the surface of the golf club head to form a nitride layer and an oxide layer. The nitride layer and oxide layer are formed by chemical reaction and are therefore bound securely to the surface and do not peel off from the surface of the golf club head.

4. No weight and size change: Because the surface treating method as described uses the nitriding means and oxidizing means for two times, the nitrogen permeates into the surface of the golf club head to form a nitride layer and an oxide layer. The golf club head does not have any extra layer so that the weight and the size of the golf club head are not changed.

5. Good appearance: The golf club head treated by the method as described has a beautiful appearance in uniform pure black, dark blue, or dark brown.

The conventional method for producing steel article disclosed in U.S. patent application No. 2007/0251605 (Kim) mentioned above, discloses a surface treating method including one nitriding step and one oxidizing step. However, the conventional method fails to disclose grinding, rinsing, checking surface and appearance, sandblasting, two oxidizing steps, preheating prior to nitriding and oxidizing, removing a loosening layer, and baking.

Four U.S. patents, which are respectively U.S. Pat. No. 6,451,129 (Sato), U.S. Pat. No. 4,496,401 (Dawes), U.S. Pat. No. 5,741,372 (Gugel) and U.S. Pat. No. 8,128,994 (Folck), disclose some of the features that Kim fails to disclose. However, the present invention is still not obvious over the five patents (including Kim) because of the following reasons.

First, none of these patents discloses grinding the golf club head. Grinding and rinsing before sandblasting the golf club head make the sandblasting easier, and make the abrasive surface formed by the sandblasting more qualified.

Second, none of these patents discloses removing a loosening layer after nitriding step, which prevents the nitride layer and the oxide layer from easily peeling off.

Third, most importantly, Kim discloses that the steel article should be cooled down prior to being oxidized, such that a person having ordinary skill in the art cannot combine Kim and Gugel, which discloses some technical features related to preheating. In the present invention, pre-heating before the nitriding makes the nitriding easier and makes the nitride layer have an even thickness. In the present invention, preheating before the second oxidizing makes the oxidizing easier and makes the dark oxide layer have an even thickness.

Lastly, for a person having ordinary skilled in the art, five patents are obviously too many to be combined.

To sum up, the present invention is not obvious over the five patents.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A surface treating method for a golf club head comprising acts of:

providing a golf club head made of carbon steel;

grinding the golf club head;

rinsing the golf club head;

checking a surface of the golf club head for inspecting whether there is any flaw on the surface of the golf club head;

sandblasting the surface of the golf club head to form a predetermined abrasive surface on the golf club head;

rinsing the sandblasted golf club head;

mounting and transporting the golf club head on a jig;

pre-heating the golf club head on the jig;

nitriding the pre-heated golf club head to form a nitride layer having good corrosion resistance and abrasion resistance on the surface of the golf club head;

first oxidizing the nitrided golf club head to form an oxide layer on the surface of the golf club head;

cooling and rinsing the golf club head;

taking off the golf club head from the jig and sandblasting or polishing the golf club head to remove a loosening layer on the nitride layer;

remounting the golf club head on the jig;

pre-heating the golf club head to 350° C. to 400° C. so that the golf club head is pre-heated to a predetermined temperature;

second oxidizing the nitrided golf club head to form a dark oxide layer on the surface of the golf club head;

cooling and rinsing the golf club head;

baking and drying the golf club head;

polishing the golf club head to display a uniform dark appearance on the golf club head;

oil immersing the golf club head by pre-heating the golf club head first and then immediately immersing the golf club head into an antirust oil, and then taking the golf club head out of the antirust oil and swabbing the golf club head to dry the golf club head; and checking an appearance of the oil immersed golf club head for inspecting whether color uniformity of the golf club head is qualified to finish the surface treatment.

2. The surface treating method for a golf club head as claimed in claim 1, wherein in the steps of pre-heating the golf club head on the jig, the golf club head passes through a pre-heated environment at 350° C. to 400° C.;

in the step of nitriding the pre-heated golf club head, the pre-heated golf club head is put into a sealed nitriding reactor at 350° C. to 400° C. for one to three hours;

in the step of first oxidizing the nitrided golf club head, the golf club head is put into an aerobic environment at 380° C. to 450° C. for thirty to sixty minutes; and in the step of second oxidizing the nitrided golf club head, the golf club head is put into an aerobic environment at 380° C. to 450° C. for thirty to sixty minutes.

3. The surface treating method for a golf club head as claimed in claim 2, wherein in the step of baking and drying the golf club head, the golf club head is put in an oven at 60° C. for about thirty minutes.

4. The surface treating method for a golf club head as claimed in claim 2, wherein the step of oil immersing the golf club head comprises acts of:

putting the golf club head into an oven at 60° C. for pre-heating;

taking the golf club head out of the oven;

immediately immersing the golf club head in the antirust oil at 60° C.;

taking the golf club head out of the antirust oil;

standing the golf club head at room temperature for fifteen to thirty minutes; and swabbing and drying the golf club head by a dry cloth.

5. The surface treating method for a golf club head as claimed in claim 3, wherein the step of oil immersing the golf club head comprises acts of:

putting the golf club head into an oven at 60° C. for pre-heating;

taking the golf club head out of the oven;

immediately immersing the golf club head in the antirust oil at 60° C.;

taking the golf club head out of the antirust oil;

standing the golf club head at room temperature for fifteen to thirty minutes; and swabbing and drying the golf club head by a dry cloth.

6. The surface treating method for a golf club head as claimed in claim 1, wherein in the step of checking a surface of the golf club head, the surface of the golf club head is checked to inspect whether holes are formed on the surface of the golf club head.

7. The surface treating method for a golf club head as claimed in claim 1, wherein in the step of checking a surface of the golf club head, the surface of the golf club head is checked to further inspect whether the shape of the golf club head is qualified.

8. The surface treating method for a golf club head as claimed in claim 1, wherein in the step of checking an appearance of the oil immersed golf club head, the golf club head is checked to inspect whether a luster of the surface of the golf club head is qualified.

* * * * *